US010975707B2

(12) United States Patent
Paradis et al.

(10) Patent No.: US 10,975,707 B2
(45) Date of Patent: Apr. 13, 2021

(54) TURBOMACHINE DISC COVER MOUNTING ARRANGEMENT

(71) Applicant: PRATT & WHITNEY CANADA CORP., Longueuil (CA)

(72) Inventors: Vincent Paradis, Longueuil (CA); Guy Lefebvre, St-Bruno-de-Montarville (CA); John Pietrobon, Outremont (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 103 days.

(21) Appl. No.: 16/225,343

(22) Filed: Dec. 19, 2018

(65) Prior Publication Data

US 2020/0200019 A1 Jun. 25, 2020

(51) Int. Cl.

| | |
|---|---|
| ***F01D 5/30*** | (2006.01) |
| ***F01D 5/32*** | (2006.01) |
| ***F01D 5/02*** | (2006.01) |

(52) U.S. Cl.

CPC ..... *F01D 5/3015* (2013.01); *F01D 5/02* (2013.01); *F01D 5/326* (2013.01); *F05D 2240/55* (2013.01); *F05D 2240/80* (2013.01); *F05D 2240/90* (2013.01); *F05D 2260/30* (2013.01)

(58) Field of Classification Search

CPC ..... F01D 5/3015; F01D 5/082; F01D 11/001

See application file for complete search history.

(56) References Cited

U.S. PATENT DOCUMENTS

| | | | | |
|---|---|---|---|---|
| 6,106,234 | A * | 8/2000 | Gabbitas | F01D 5/3015 416/220 R |
| 6,520,743 | B2 * | 2/2003 | Arilla | F01D 5/3015 416/204 A |
| 6,575,703 | B2 * | 6/2003 | Simeone | F01D 5/066 416/220 R |
| 7,371,050 | B2 * | 5/2008 | Pasquiet | F01D 5/3015 416/204 A |
| 7,597,499 | B2 | 10/2009 | Udall | |
| 9,567,857 | B2 | 2/2017 | Snyder | |
| 10,024,183 | B2 | 7/2018 | Patryka et al. | |
| 10,100,652 | B2 * | 10/2018 | Weise | F01D 11/02 |

* cited by examiner

*Primary Examiner* — Justin D Seabe

(74) *Attorney, Agent, or Firm* — Norton Rose Fulbright Canada LLP

(57) ABSTRACT

A gas turbine engine rotary assembly comprises a disc mounted for rotation about an axis and having a first bayonet feature, a cover mounted to the disc; and a retaining ring having a second bayonet feature engaged with the first bayonet feature of the disc.

18 Claims, 6 Drawing Sheets

TURBOMACHINE DISC COVER MOUNTING ARRANGEMENT

TECHNICAL FIELD

The application relates generally to gas turbine engine and, more particularly, to a turbomachine disc cover mounting arrangement

BACKGROUND OF THE ART

Coverplates are often mounted to turbomachine discs to provide sealing and/or blade retention. However, in some applications, the space available to install the coverplate may be restricted by existing adjacent hardware.

There is thus a continued need for alternative coverplate mounting arrangement.

SUMMARY

In one aspect, there is provided a rotary assembly for a gas turbine engine, the rotary assembly comprising: a disc mounted for rotation about an axis and having a first bayonet feature; a cover mounted to the disc; and a retaining ring having a second bayonet feature engaged with the first bayonet feature of the disc, the cover retained axially between the disc and the retaining ring.

In another aspect, there is provided a mounting arrangement for retaining a cover on a disc of a turbomachine rotor, the mounting arrangement comprising: a first bayonet feature provided on a stub shaft projecting axially from one face of the disc, a retaining ring engageable over the stub shaft and configured to retain an inner diameter portion of the cover on the disc, the retaining ring having a second bayonet feature engageable with the first bayonet feature of the disc, the second bayonet feature being axially biased against the first bayonet feature by the cover.

In a further aspect, there is provided a method of assembling a cover to a turbomachine disc comprising: positioning the cover over one face of the turbomachine disc, and then engaging a bayonet feature of a retaining ring with a corresponding bayonet feature of the turbomachine disc, the cover being axially trapped at an inner diameter portion thereof between the disc and the retaining ring.

DESCRIPTION OF THE DRAWINGS

Reference is now made to the accompanying figures in which.

DETAILED DESCRIPTION

Figure 1:
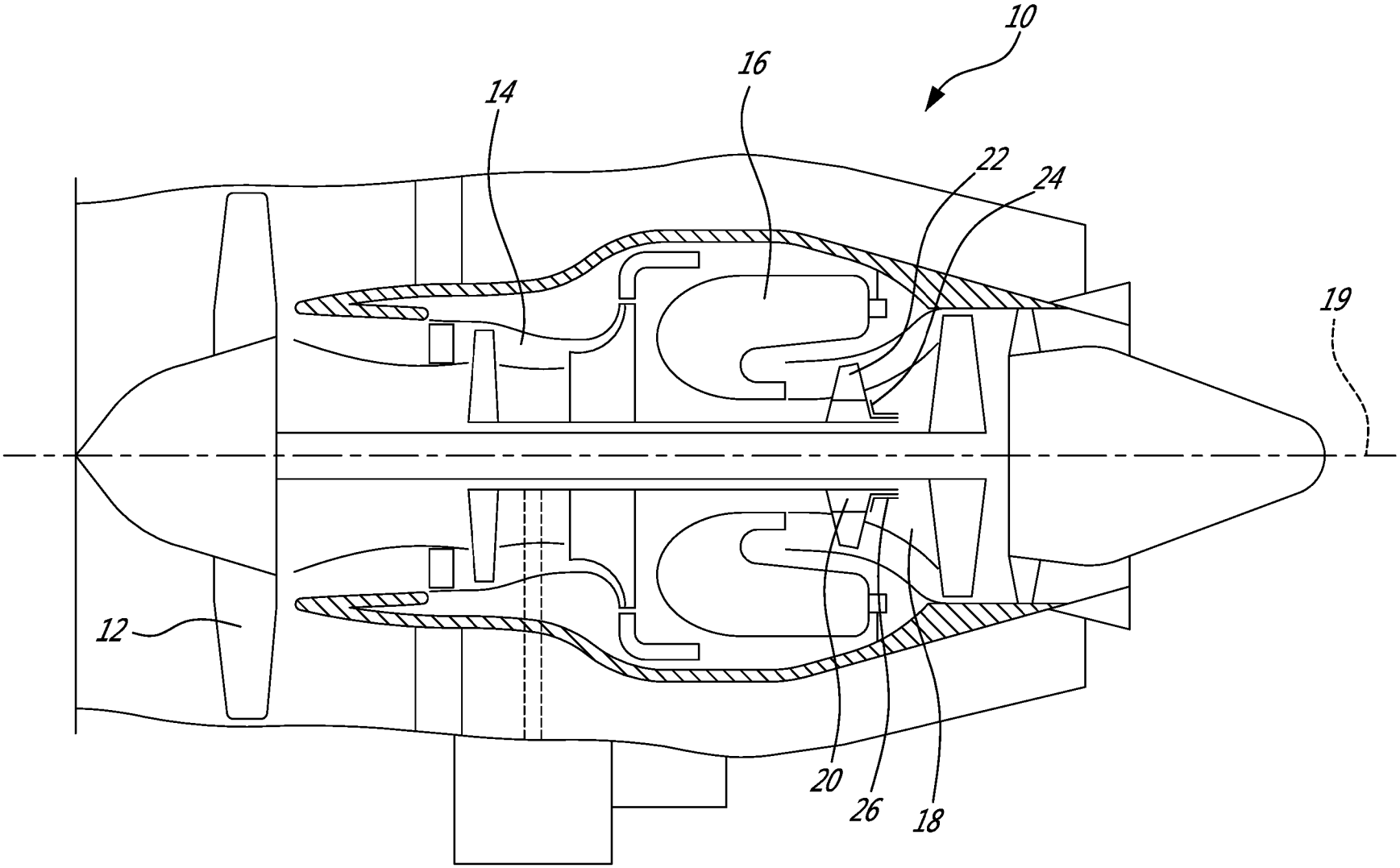
FIG. 1 is a schematic cross-section view of a gas turbine engine including a bayoneted retaining ring for retaining a disc cover on a turbomachine disc in accordance with one embodiment.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
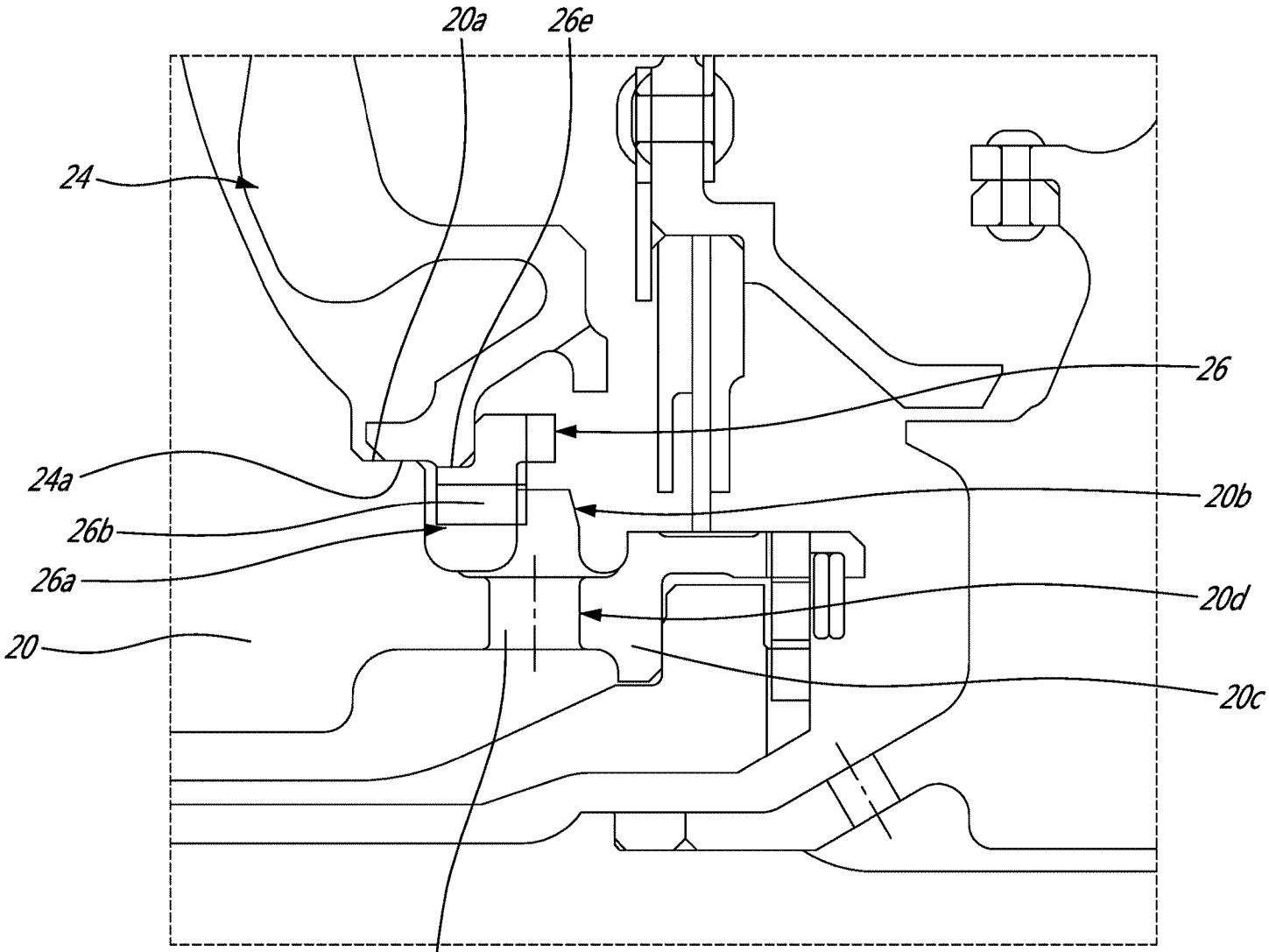
FIG. 2 is an enlarged cross-section view illustrating the bayoneted retaining ring cooperating with a corresponding bayonet feature of the turbomachine disc to retain the cover on the disc.
Figure 4:
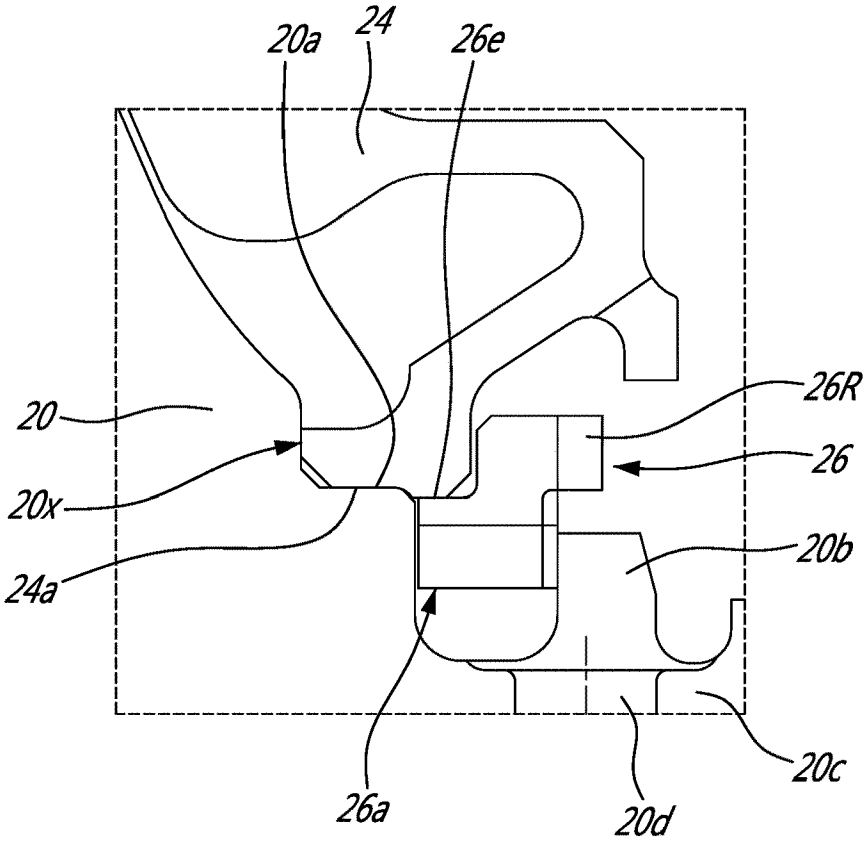
FIG. 4 is an enlarged cross-section view illustrating the cover and the retaining ring in an assembly position with the cover elastically deformed beyond its running position to allow the rotation of the retaining ring to align the bayonet feature of the ring with the bayonet feature of the disc.
Figure 3:
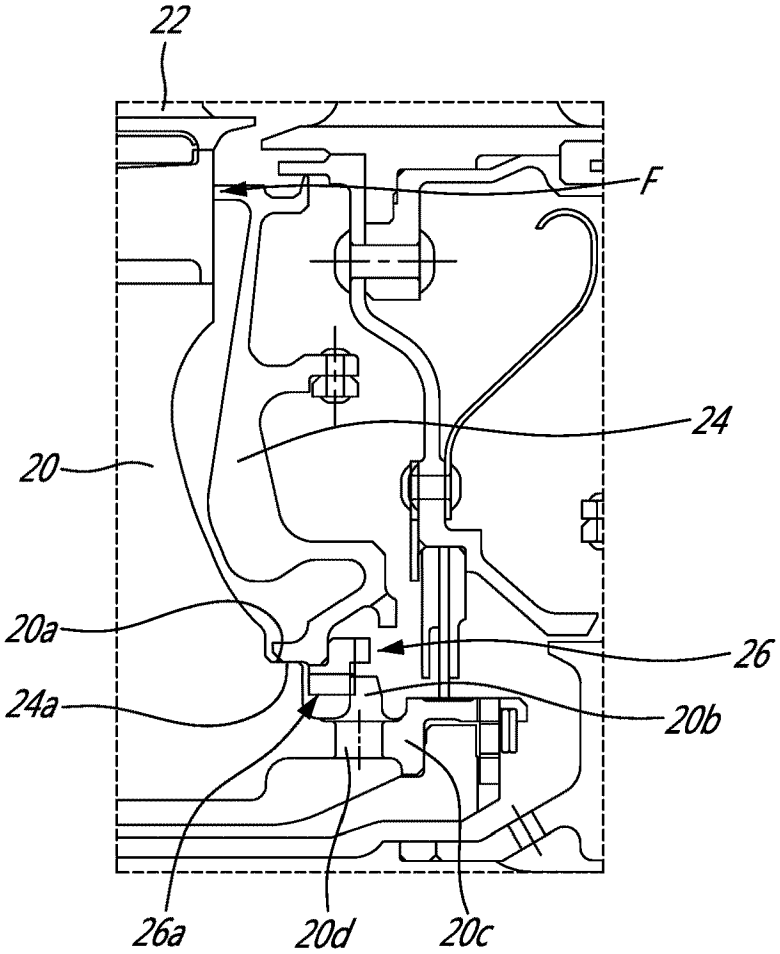
FIG. 3 is a cross-section view illustrating an axial interference between the cover and the disc for urging the bayonet feature of the retaining ring in engagement with the corresponding bayonet feature of the turbomachine disc.
Figure 5:
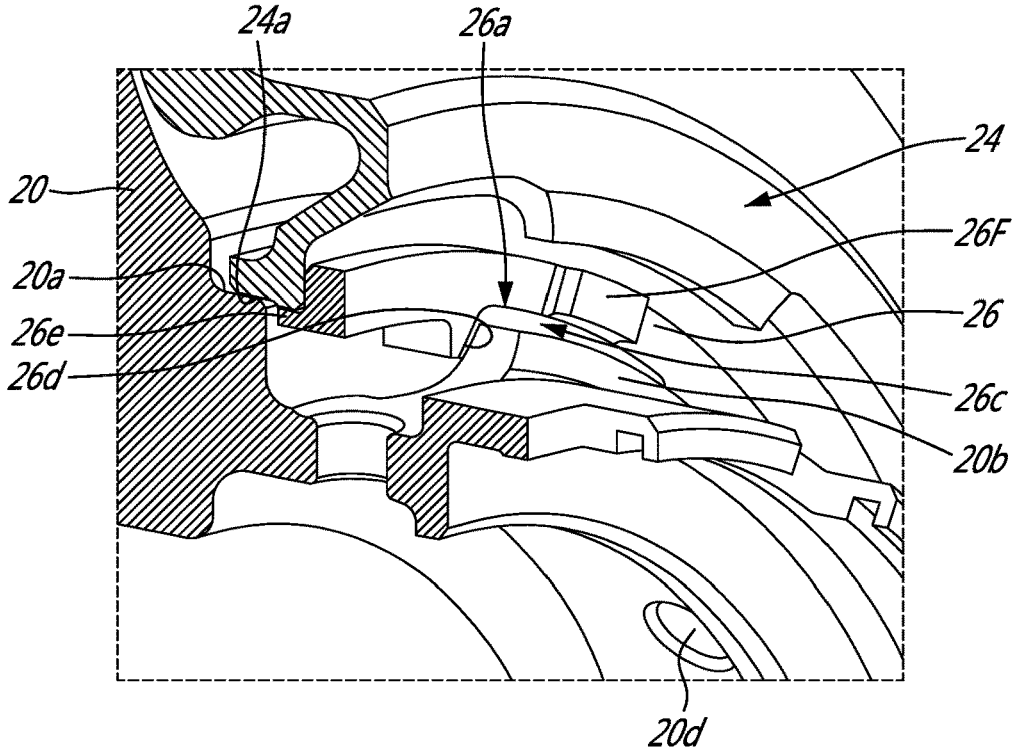
FIG. 5 is an enlarged isometric cross-section view illustrating a bayonet feature of the retaining ring engaged behind a corresponding bayonet feature of the disc.
Figure 6:
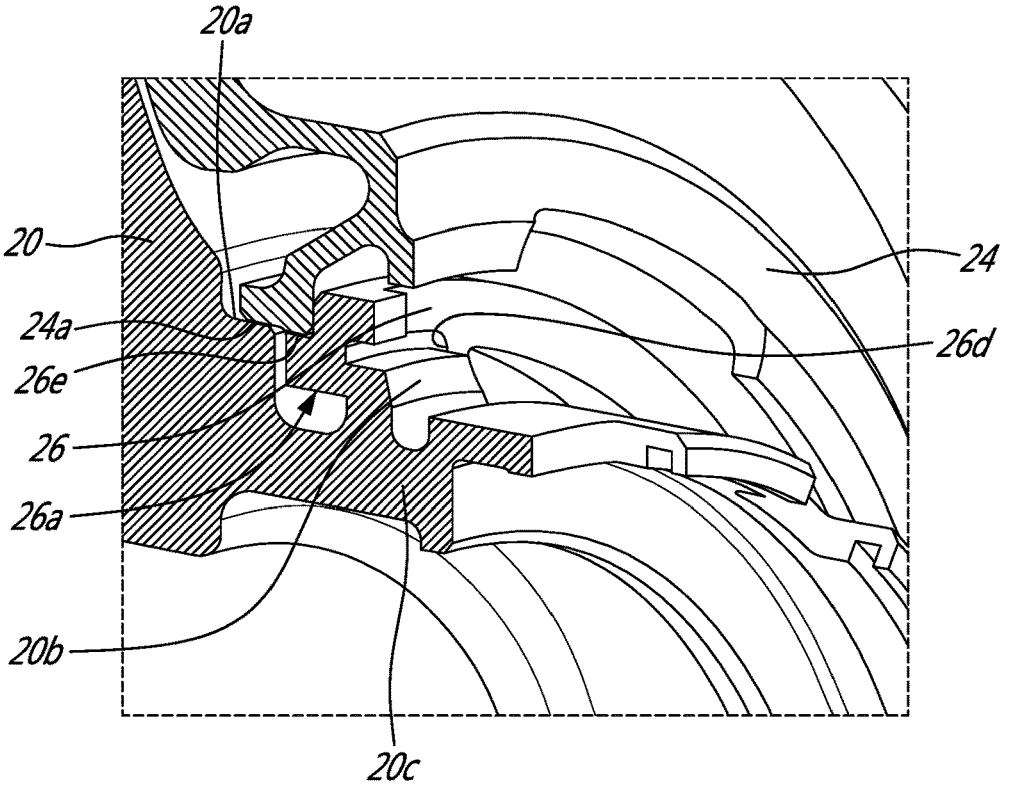
FIG. 6 an enlarged isometric cross-section taken through the bayonet features of the ring and the disc.

As schematically illustrated in FIG. 1, the turbine section 18 comprises a turbine disc 20 mounted for rotation about the engine centerline 19. The turbine disc 20 carries a circumferential array of turbine blades 22 which extend into the gaspath downstream of the combustor 16. A turbine disc cover 24 covers the aft face of the turbine disc 20. It is understood that the cover 24 could also be provided on the front face of the disc 20. The cover 24 may be used to provide sealing as well as blade retention. As shown in FIGS. 2 to 4, the inner diameter 24*a* of the cover 24 may be engaged on an annular shoulder 20*a* formed on the aft facing side of the disc 20. As will be seen hereinafter a bayoneted retaining ring 26 is used to retain the cover 24 on the shoulder 20*a* of the turbine disc 20. The ring 26 may be provided in the form of a split ring or a circumferentially uninterrupted/continuous ring.

Referring concurrently to FIGS. 2 to 6, it can be appreciated that the disc 20 has a first bayonet feature configured to cooperate with a second bayonet feature provided on the retaining ring 26. In accordance with a particular embodiment, the first bayonet feature includes a plurality of circumferentially spaced-apart lugs 20*b* extending radially outwardly from a stub shaft 20*c* extending integrally axially from an aft facing side of the disc 20. In the particular illustrated embodiment, the disc lugs 20*b* are circumferentially positioned in-between cooling holes 20*d* extending radially through the stub shaft 20*c* for allowing secondary air to pressurize the rotor downstream cavity. Still in accordance with the illustrated exemplary embodiment, the second bayonet feature includes a plurality of circumferentially spaced-apart ring lugs 26*a* extending radially inwardly from an inner diameter of the retaining ring 26.

Figure 7A:
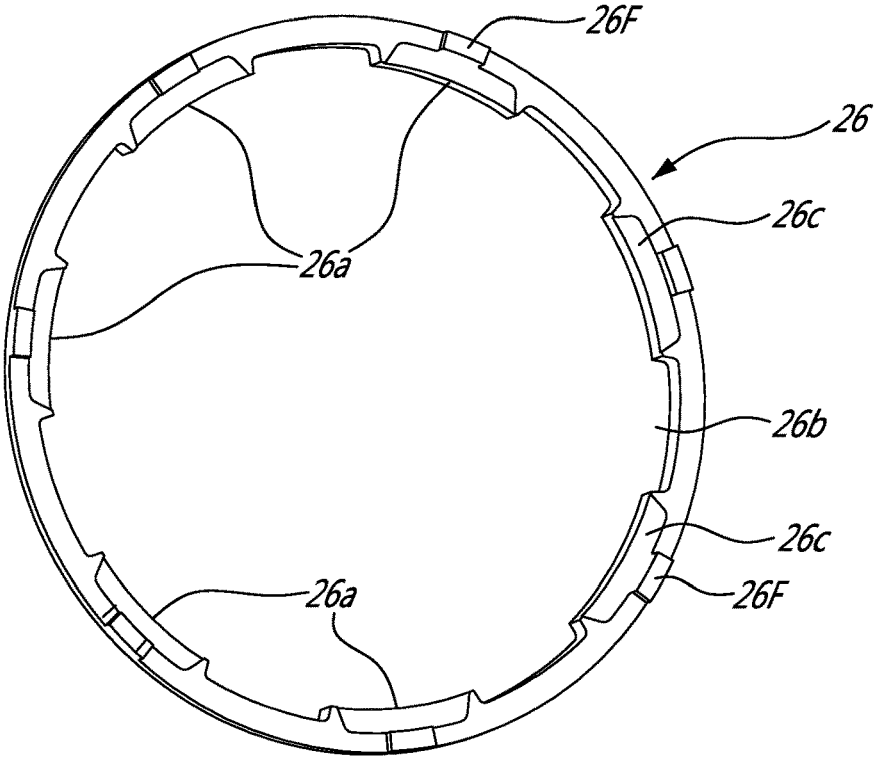
FIG. 7*a* is a disc interface side view of the retaining ring.
Figure 7B:
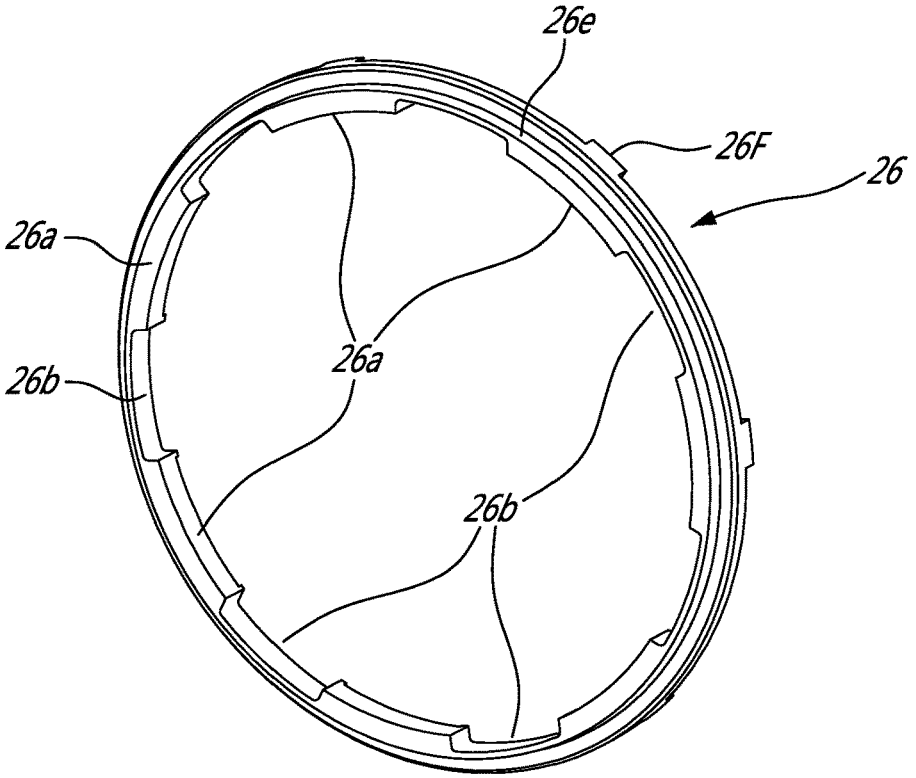
FIG. 7*b* is a cover interface side view of the retaining ring.

As best shown in FIGS. 7*a* and 7*b*, openings 26*b* are defined between adjacent ring lugs 26*a*. The openings 26*b* are sized to allow the assembly of the ring 26 around the disc lugs 20*b* (i.e. the inter-lug openings allow the ring 26 to clear the disc lugs 20*b* while the ring 26 is axially fitted over the stub shaft 20*c* axially behind the disc lugs 20*b*). As can be seen from FIG. 7*a*, undercuts 26*c* may be machined in the disc interface side of the ring lugs 26*a* to act as anti-rotation features to prevent the ring 26 from rotating in the circumferential direction relative to disc 20. More particularly, the undercuts 26*c* are configured to receive the disc lugs 20*b* in a male-female mating relationship. The undercuts 26*c* are bounded in the circumferential direction by opposed circumferential walls 26*d* acting as arresting surfaces for the disc lugs 20*b*, thereby locking the ring 26 in rotation relative to the disc 20. The lugs 20*b*, 26*a* thus fulfill both an axial retention and an anti-rotation function. The integration of anti-rotation features in the lugs 20*b*, 26*a* eliminates the need for separate anti-rotation features between the ring 26 and the disc 20. Accordingly, it simplifies the assembly process and reduces the part count.

Figure 8:
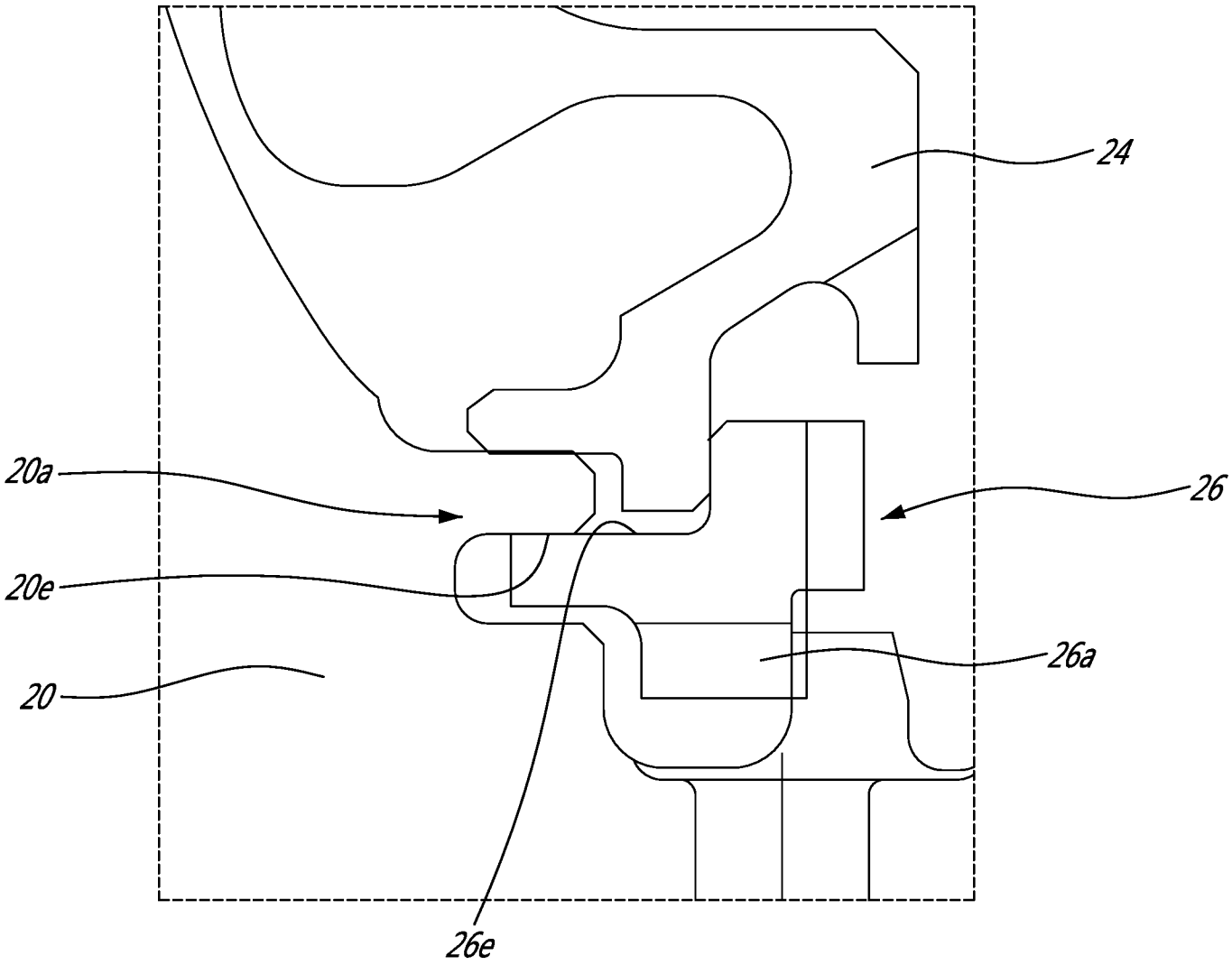
FIG. 8 is an enlarged cross-section view illustrating a design variation with the disc radially supporting the retaining ring.

As shown in FIGS. 2 to 6 and 7*b*, an annular shoulder 26*e* may be formed on a cover interface side of the retaining ring 26 (opposite the disc interface side thereof) for engagement in a radial direction with an inner diameter surface of the cover 24. Alternatively, as shown in FIG. 8, the ring 26 may be radially supported by engaging its annular shoulder 26*e* with a radially inner surface 20*e* defined in the disc 20 underneath the annular shoulder 20*a* on which the cover 24 is mounted.

Referring back to FIG. 7*a*, it can be seen that the retaining ring 26 may also be provided with positioning or handling aids to facilitate handling thereof. For instance, circumferentially spaced-apart assembly lugs 26*f* may project axially from the disc interface side of the ring 26 for engagement with a tool (not shown). The assembly lugs 26*f* can be engaged with a tool for rotating the ring 26 relative to the disc 20 so as to angularly align the ring lugs 26*a* with the disc lugs 20*b* once the ring 26 has been positioned behind the disc lugs 20*b*. Alternatively, other suitable handling structures configured for engagement with a tool may be provided on the ring to facilitate the manipulation thereof during assembly. For instance, assembly holes (not shown) could be defined in the ring 26 for engagement with a tool.

The cover 24 is assembled on the disc 20 by first axially engaging the inner diameter of the cover 24 over shoulder 20*a* of disc 20. Then, the retaining ring 26 is fitted on the stub shaft 20*c* of the disc 20 and is angularly oriented such that the ring lugs 26*a* are angularly offset relative to the disc lugs 20*b* (i.e. the openings 26*b* aligned with the disc lugs 20*b*). Thereafter, the ring 26 is axially moved in abutment against an inner diameter portion of the cover 20. The ring lugs 26*a* are engaged behind the disc lugs 20*b* by pushing the ring 26 axially against the cover 24 so as to elastically deform the cover 24 beyond its running position (the running position is shown in FIGS. 2 and 3). Alternatively, the ring lugs 26*a* are engaged behind the disc lugs 20*b* by pushing the cover 24 against the disc surface 20*x* so as to elastically deform the cover 24 beyond its running position (the running position is shown in FIGS. 2 and 3), thereby providing the required clearance for positioning ring lugs 26*a* axially behind the disc lugs 20*b*. This allows to fully clearing the disc lugs 20*b*, as shown in FIG. 4. Then, the ring 26 is rotated so as to angularly align the ring lugs 26*a* with the disc lugs 20*b*. This manipulation can be facilitated by the use of the assembly lugs 26*f*. Once the ring lugs 26*a* are aligned with the disc lugs 20*b*, the cover 24 can now be released to spring back to its running position and exert an axial pressure on the ring 26 because of the axial interference F (FIG. 3) at the disc and cover outer rim interface. The cover 24 is thus used to positively axially bias the ring lugs 26*a* in firm engagement with the disc lugs 20*b*. In this position, the disc lugs 20*b* are retained captive in the undercuts 26*c* provided on the disc interface side of the ring lugs 26*a*, thereby positively locking the ring 26 in rotation relative to the disc 20.

The use of a bayoneted retaining ring provides for a compact cover retaining arrangement. For instance, according to the illustrated example, it allows to axially superimpose the holes 20*d* with the cover retaining feature, thereby saving a significant amount of axial space. Also removing the disc cover from the rotor stack assembly allows avoiding potential unbalance.

The above description is meant to be exemplary only, and one skilled in the art will recognize that changes may be made to the embodiments described without departing from the scope of the invention disclosed. For example, while the general aspects of the invention have been exemplified in the context of a turbofan, it is understood that the same principles could be applied to other turbomachinery. For instance, the gas turbine engine could be a turboshaft, a turboprop or an auxiliary power unit (APU). Also, a person skilled in the art will understand that bayoneted rings are not limited for mounting on turbine disc. Indeed, bayoneted rings could be used to retain disc covers on other turbomachine discs or rotors. Furthermore, while the disc bayonet feature and the ring bayonet feature have been described as lugs, it is understood that the bayonet features could take various forms. For instance they could take the form of a pin engageable in an associated catch or slot. Also, the number of lugs could vary depending on the intended application. The anti-rotation features integrated to lugs can also adopt various configurations. For instance, depressions or projections could be formed on the disc lugs to provide circumferential arresting surfaces for the ring lugs. Still other modifications which fall within the scope of the present invention will be apparent to those skilled in the art, in light of a review of this disclosure, and such modifications are intended to fall within the appended claims.

The invention claimed is:

1. A rotary assembly for a gas turbine engine, the rotary assembly comprising:

a disc mounted for rotation about an axis and having a first bayonet feature;

a cover mounted to the disc; and a retaining ring having a second bayonet feature engaged axially behind the first bayonet feature of the disc, the cover axially biasing the second bayonet feature of the retaining ring in axial engagement with the first bayonet feature of the disc.

2. The rotary assembly defined in claim 1, wherein the first and second bayonet features are provided with anti-rotation features to lock the retaining ring against rotation relative to the turbine disc.

3. The rotary assembly as defined in claim 1, wherein the first bayonet feature includes a plurality of circumferentially spaced-apart disc lugs, the second bayonet feature includes a plurality of circumferentially spaced-apart ring lugs, and wherein the retaining ring is rotatable between a first angular orientation wherein the plurality of circumferentially spaced-apart ring lugs are angularly offset with respect to the plurality of circumferentially spaced-apart disc lugs, thereby allowing the retaining ring to be installed on the disc axially behind the plurality of circumferentially spaced-apart disc lugs, and a second in use angular orientation in which the plurality of circumferentially spaced-apart ring lugs are angularly aligned with the plurality of circumferentially spaced-apart disc lugs to prevent the retaining ring to move axially away from the disc.

4. The rotary assembly as defined in claim 3, wherein the plurality of circumferentially spaced-apart disc lugs project radially outwardly from an axially extending stub shaft portion of the disc, and wherein the plurality of circumferentially spaced-apart ring lugs project radially inwardly from an inner dimeter of the retaining ring.

5. The rotary assembly as defined in claim 3, wherein at least one of the plurality of circumferentially spaced-apart ring lugs or at least one of the plurality of circumferentially spaced-apart disc lugs has an anti-rotation recess formed in an axially facing surface thereof for receiving a corresponding one of the plurality of circumferentially spaced-apart disc lugs or a corresponding one of the plurality of circumferentially spaced-apart ring lugs in a circumferential captive manner to lock the retaining ring in rotation relative to the disc.

6. The rotary assembly as defined in claim 5, wherein the anti-rotation recess is provided in the form of an undercut machined in the axially facing surface of the at least one of the plurality of circumferentially spaced-apart ring lugs or the at least one of the plurality of circumferentially spaced-apart disc lugs, the undercut being circumferentially bounded by end walls providing arresting surfaces for the corresponding one of the plurality of circumferentially spaced-apart disc lugs or the corresponding one of the plurality of circumferentially spaced-apart ring lugs.

7. A mounting arrangement for retaining a cover on a disc of a turbomachine rotor, the mounting arrangement comprising: a first bayonet feature provided on a stub shaft projecting axially from one face of the disc, a retaining ring engageable over the stub shaft and configured to retain an inner diameter portion of the cover on the disc, the retaining ring having a second bayonet feature axially engageable behind the first bayonet feature of the disc, the second bayonet feature being axially biased against the first bayonet feature by the cover as a result of an interference fit (F) at an outer rim interface between the disc and the cover.

8. The mounting arrangement as defined in claim 7, wherein the first bayonet feature comprises a plurality of circumferentially spaced-apart disc lugs projecting radially outwardly from the inner diameter portion of the disc, and wherein the second bayonet feature comprises a plurality of circumferentially spaced-apart ring lugs projecting radially inwardly from an inner diameter of the retaining ring, the plurality of circumferentially spaced-apart ring lugs being axially insertable between the plurality of circumferentially spaced-apart disc lugs, the retaining ring being rotatable in a circumferential direction to angularly align the plurality of circumferentially spaced-apart ring lugs behind the plurality of circumferentially spaced-apart disc lugs.

9. The mounting arrangement defined in claim 8, wherein the plurality of circumferentially spaced-apart ring lugs and the plurality of circumferentially spaced-apart disc lugs have complementary male-female interfacing surfaces including circumferential arresting surfaces to prevent rotation of the retaining ring in a circumferential direction relative to the disc.

10. The mounting arrangement defined in claim 9, wherein the plurality of circumferentially spaced-apart ring lugs have a ring interface side opposite to a cover interface side, and wherein the plurality of circumferentially spaced-apart ring lugs incorporate undercuts on the ring interface side to accommodate the plurality of circumferentially spaced-apart ring lugs.

11. The mounting arrangement defined in claim 10, wherein the undercuts are circumferentially bordered by circumferentially opposed end walls providing arresting surfaces for the plurality of circumferentially spaced-apart disc lugs in the circumferential direction.

12. The mounting arrangement defined in claim 8, wherein the retaining ring has a cover interface side, and wherein the retaining ring is provided with a positioning aid on a side thereof opposite to the cover interface side.

13. The mounting arrangement defined in claim 12, wherein the positioning aid includes assembly lugs projecting axially from the retaining ring in a direction away from the cover.

14. The mounting arrangement defined in claim 7, wherein the first bayonet feature includes a plurality of circumferentially spaced-apart disc lugs, the second bayonet feature includes a plurality of circumferentially spaced-apart ring lugs, and wherein the retaining ring is rotatable between a first angular orientation wherein the plurality of circumferentially spaced-apart ring lugs are angularly offset with respect to the plurality of circumferentially spaced-apart disc lugs, thereby allowing the retaining ring to be fitted on the stub shaft of the disc axially behind the plurality of circumferentially spaced-apart disc lugs, and a second in use angular orientation in which the plurality of circumferentially spaced-apart ring lugs are angularly aligned with the plurality of circumferentially spaced-apart disc lugs to prevent the retaining ring to move axially away from the disc.

15. A method of assembling a cover to a turbomachine disc mounted for rotation about an axis, the method comprising: positioning the cover over one face of the turbomachine disc, and then axially engaging a bayonet feature of a retaining ring behind a corresponding bayonet feature of the turbomachine disc, wherein axially engaging comprises pushing the retaining ring axially against the cover towards the face of the turbomachine disc so as to elastically deform the cover beyond a running position thereof and then allowing the cover to spring back to its running position in a direction away from the face of the turbomachine disc, the cover being axially trapped at an inner diameter portion thereof between the disc and the retaining ring.

16. The method defined in claim 15, wherein the bayonet feature of the retaining ring includes a plurality of circumferentially spaced-apart ring lugs, the corresponding bayonet feature of the turbomachinery bayonet feature including a plurality of circumferentially spaced-apart disc lugs, and wherein the method comprises: carrying the retaining ring axially towards the turbomachine disc with the circumferentially spaced-apart ring lugs angularly offset with respect to the plurality of circumferentially spaced-apart disc lugs so that the plurality of circumferentially spaced-apart ring lugs clear the plurality of circumferentially spaced-apart disc lugs, and then when the plurality of circumferentially spaced-apart ring lugs are axially positioned behind the plurality of circumferentially spaced-apart disc lugs, rotating the retaining ring to align the plurality of circumferentially spaced-apart ring lugs with the plurality of circumferentially spaced-apart disc lugs.

17. The method defined in claim 16, wherein carrying the retaining ring comprises axially pushing the retaining ring against the cover so as to cause an elastic deformation of the cover, and then rotating the retaining ring to align the plurality of circumferentially spaced-apart ring lugs with the plurality of circumferentially spaced-apart disc lugs.

18. The method defined in claim 15 comprising using the cover to axially bias the bayonet feature of the retaining ring in engagement with the corresponding bayonet feature of the turbomachine disc.

* * * * *